US005483703A

United States Patent [19]

Williams

[11] Patent Number: 5,483,703

[45] Date of Patent: Jan. 16, 1996

[54] WATERPROOF, BREATHABLE ARTICLES OF APPAREL FOR A WEARER'S EXTREMITIES

[76] Inventor: Cole Williams, 2408 Allanjay Pl., Glendale, Calif. 91208

[21] Appl. No.: 959,115

[22] Filed: Oct. 9, 1992

[51] Int. Cl.[6] ..... A41B 11/00

[52] U.S. Cl. ..... 2/239; 2/87; 2/159; 2/161.7; 2/164; 2/167

[58] Field of Search ..... 2/239, 409, 87, 2/243 A, 159, 158, 161.7, 164, 167; 156/212, 213, 306.6, 308.2, 309.6, 322, 292, 290, 148; 264/222, 241; 36/4, 9 R, 10; 12/142 G

[56] References Cited

U.S. PATENT DOCUMENTS

| | | | |
|---|---|---|---|
| 3,953,566 | 4/1976 | Gore . | |
| 4,194,041 | 3/1980 | Gore et al. . | |
| 4,310,373 | 1/1982 | Schuhmacher et al. . | |
| 4,311,543 | 1/1982 | Strickman et al. | 156/308.2 |
| 4,377,617 | 3/1983 | Ikei et al. | 156/306.6 |
| 4,679,257 | 7/1987 | Town . | |
| 4,686,137 | 8/1987 | Ward, Jr. et al. . | |
| 4,773,238 | 9/1988 | Zafiroglu . | |
| 4,809,447 | 3/1989 | Pacanowsky et al. . | |
| 4,845,862 | 7/1989 | Phillips, Jr. et al. | 36/4 |
| 4,876,128 | 10/1989 | Zafiroglu . | |
| 4,967,494 | 11/1990 | Johnson . | |
| 4,998,421 | 3/1991 | Zafiroglu . | |

FOREIGN PATENT DOCUMENTS

| | | |
|---|---|---|
| 0288214 | 4/1988 | European Pat. Off. . |
| 9110374 | 12/1990 | WIPO . |

OTHER PUBLICATIONS

Gil, et al., The Principles of Ultrasonic Bonding and Web Handling Holliday, In Search of the Perfect Nonwoven Fabric.

A Guide to Branded Fibers & Fabrics for Skiwear; The Sporting Goods Dealer.

Bonding and Web Forming Technologies, Nonwovens Industry–Oct. 1991.

*Primary Examiner*—C. D. Crowder
*Assistant Examiner*—Gloria Hale
*Attorney, Agent, or Firm*—James E. Brunton

[57] ABSTRACT

A footwear article and the method of making the same which will allow water vapor due to perspiration to transpire through the article but will prevent liquid water from external sources from reaching the wearer's foot. One form of the footwear article of the invention comprises a sock which is of three-ply construction with the inside and outside plies being knit and the intermediate ply being made from an elastomeric polyurethane film. The three plies are uniquely bonded together using a pliant, waterproof adhesive.

42 Claims, 1 Drawing Sheet

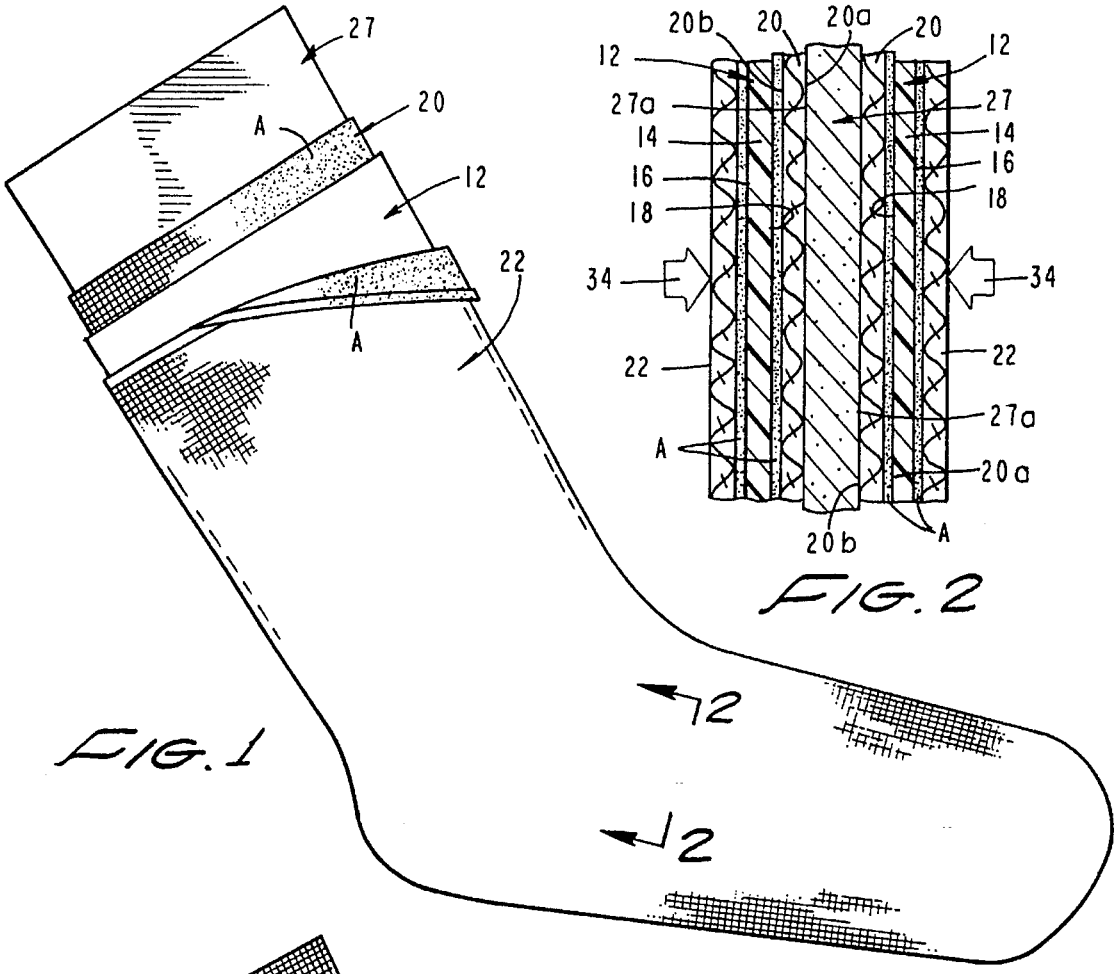
FIG. 1
FIG. 2
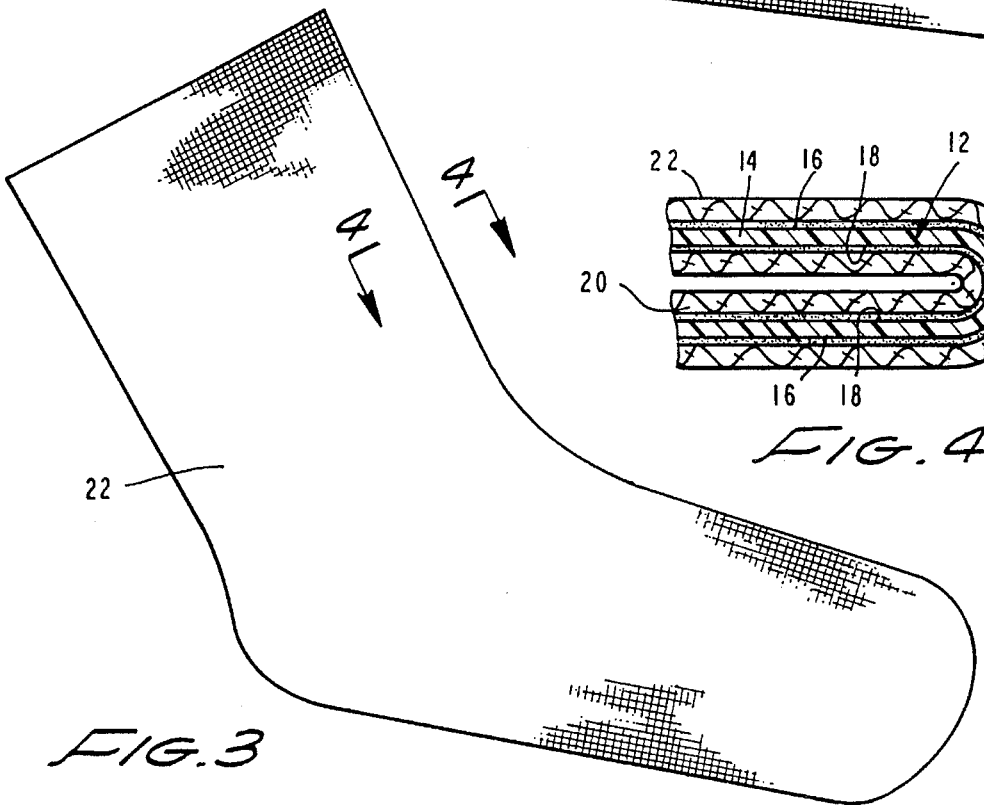
FIG. 3
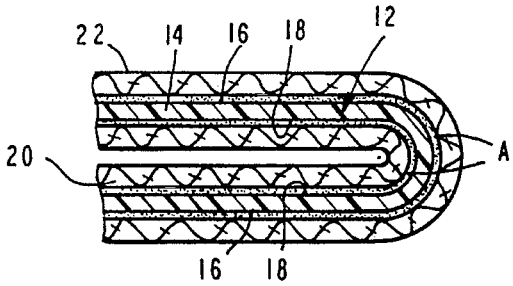
FIG. 4

WATERPROOF, BREATHABLE ARTICLES OF APPAREL FOR A WEARER' S EXTREMITIES

BACKGROUND OF THE INVENTION

1. Field of the Invention

The present invention relates generally to articles of apparel. More particularly, the invention concerns articles of apparel used to cover the wearer's extremities such as an improved, waterproof sock that will permit perspiration to transpire through the sock, but will keep water from external sources away from the wearer's foot.

2. Discussion of the Invention

Various attempts have been made in the past to produce breathable, waterproof articles of apparel such as gloves and socks that will keep the wearer's hands and feet dry and at the same time permit perspiration to transpire through the article. Materials which will accomplish this desired function have been known for sometime. For example, U.S. Pat. No. 3,953,566 discloses a method of making an expanded polytetrafluoroethylene (PTFE) that possesses the properties of being both breathable and waterproof. An improvement of this material is described in U.S. Pat. No. 4,194,041. While both of these materials have been used in the construction of footwear, they exhibit the drawback that they have limited stretchability, thereby making them less than ideally suited for construction of footwear such as socks. In addition, such footwear typically has sewn seems and tapes which make it bulky and uncomfortable.

In an apparent attempt to overcome the problems discussed in the preceding paragraph, a multi-component sock type article was suggested. This article, which is described in U.S. Pat. No. 4,819,447 issued to Pacanowsky, et al., comprises a waterproof, nonelastic, non-stretch sole component, a non-stretch calf component and a vamp component attached to the sole and calf components.

As will be better appreciated from the discussion which follows, the footwear article of the present invention provides, for the first time, footwear such as socks construction which exhibit the comfort and stretchability of a traditional type of sport sock and at the same time are both breathable and completely waterproof.

SUMMARY OF THE INVENTION

It is an object of the present invention to provide comfortable articles of apparel and the method of making the same which will allow water vapor due to perspiration to transpire through the article but will prevent water from external sources from reaching the wearer's extremities.

A particular object of the invention is to provide a footwear article of the aforementioned character which fits well, is pliant and is durable in use.

Another object of the invention is to provide an article such as a glove or sock in which water vapor from perspiration can be transmitted from inside to outside so that the natural evaporative cooling effect can be achieved.

Another object of the invention is to provide a method of making articles of the character described in the preceding paragraphs which is simple and straight forward, does not require the use of complicated equipment such as sewing and seaming equipment and can be performed by unskilled workmen with a minimum of training.

A particular object of the invention is to provide a sock as described in the preceding paragraphs which is of simple construction and is easy to manufacture.

In its preferred form, the footwear article of the invention comprises a sock which is of three-ply construction with the inside and outside plies being knit and the intermediate ply being made from an elastomeric polyurethane film. The three-plies are uniquely bonded together using a pliant, waterproof adhesive.

BRIEF DESCRIPTION OF THE DRAWINGS

FIG. 1 is a side-elevational view illustrating the method of making the footwear article of the invention and showing the components of the article in position over a foot-shaped planar mandrel.

FIG. 2 is an enlarged cross-sectional view taken along lines 2—2 of FIG. 1.

FIG. 3 is a side-elevational view of one form of the footwear article of the invention.

FIG. 4 is an enlarged cross-sectional view taken along lines 4—4 of FIG. 3.

DESCRIPTION OF THE INVENTION

In the description which follows:

The term "breathable" means the ability of an article to transport interior moisture vapor to the external environment.

As used herein, the term "waterproof" means the ability of an article to substantially prevent liquid water from external sources from reaching the interior of the article.

Similarly, the term "fabric" as used herein means a sheet structure made from fibers, filaments or yarns. Non-limiting examples include woven or nonwoven sheets made by weaving, knitting, felting, hydroentangling or meltblowing fibers, filaments or yarns.

The term "sock" as used herein means a short, close-fitting covering for the foot and lower leg constructed from any suitable material such as natural and synthetic fibers.

Referring to the drawings, FIGS. 3 and 4 show one form of the clothing article of the present invention. The article here comprises a sock construction including a thin, pliant bladder 12 constructed from a waterproof, breathable material, such as polyurethane sheet. The polyurethane sheet can be of various thickness as, for example, between about 0.5 mils and about 3 mils. Bladder 12 includes a foot portion 14 having an outer surface 16 and an inner surface 18. Bladder 12 has the unique capability of generally conforming to the contours of the human foot so that it can be comfortably worn inside a boot or shoe.

Bonded to the inner surface 18 of the elastomeric bladder is a light-weight covering member such as a fabric inner sock 20 of standard construction which is preferably made from knitted natural or synthetic fibers.

The article of the invention shown in FIG. 3 also includes an outer sock 22 which is bonded to the outer surface of bladder 12. Sock 22 can also be constructed from filament or spun yarns. The sock can also be constructed from natural fibers; such as wool fibers, or from a variety of synthetic fibers such as polyester nylon and combinations thereof.

Socks 20 and 22 are preferably bonded to bladder 12 by means of a waterproof, heat activated adhesive. A hot melt adhesive in powder form sold by Bostik, Middleton, Mass., product #5116, a polyester type, has proven satisfactory for this purpose. Other adhesives can, of course, also be used, including breathable adhesives. In any event, the adhesive should be selected and applied in a manner that the breathability of the footwear is not destroyed or substantially reduced.

For certain applications the footwear article of the invention can be constructed by bonding to the bladder only a single inner or outer sock. This two, rather than three-ply construction, can be used in a number of applications in which the three or more ply constructions are too bulky or too expensive.

The thin pliant, thermoplastic material from which the waterproof, breathable bladder will be made is of a character that will prevent penetration of liquid water while at the same time permitting free passage of moisture vapor such as perspiration. This material can be a polyurethane sometimes described as thermoplastic urethane. A suitable material of this type is sold by Fabrite Laminating Corp. of Woodridge, N.J. Other suitable materials include elastomers made from polyesters, copolyesters, polyamides, cellulose derivatives, polyacrylic acid and its hololog, natural or synthetic rubber with hydrophilic impurities, copolyozamides, polyureas, polyelectrolytes, polyphosphates, polyvinylamid, polyvinylalcohol, polyether, and copolymers thereof, polythioether, polythioether-polyether, copolyepichlorohydrin-ether, polysulphosphates, copolyester-ether and derivatives or mixtures thereof.

Considering now the method of the invention, the thin, pliant bladder material is first coated with a light coating of the powdered hot melt adhesive, Bostik #5116. The adhesive particles randomly cover the bladder evenly to a density of about 20% coverage of the surface area. This bladder material with adhesive is then heated to a temperature slightly above the softening point of the adhesive, thereby causing the discrete particles of adhesive to fuse to the surface of the bladder material. In the case of Bostik #5116, the softening point is 268 degrees Fahrenheit. This means is also used to coat particles of adhesive on both sides of the bladder material.

The next step is the construction of the waterproof, breathable bladder. In one form of the method of the invention this is accomplished by overlaying two sheets of the previously described adhesive coated bladder material and to define on the sheets of material a line circumscribing the boundary of the bladder. This done, the sheets of material are heated along the boundary line to a temperature sufficient to sealably bond the sheets together along the boundary line.

The heating-fusion step can be accomplished in several ways well known to those skilled in the art, including using a heated wire or die having the shape of the bladder-boundary. Heating can also be accomplished through the use of well-known radio frequency and ultrasonic welding techniques.

One technique which has proven to be satisfactory in making the footwear of the invention, involves the use of a heated platen press embodying a die having the shape of the outer boundary of the bladders. The die is electrically heated to about 500 degrees Fahrenheit. One of the cooperating platens of the platen press is maintained at room temperature and, is lined with a flexible fabric such as felt. The two sheets of the adhesive-coated bladder material are placed between two sheets of polytetrafluoroethylene coated fiber glass sheets which act as separator material and also allow the heat from the die to penetrate to the film. Appropriate heating of the dies causes the sheets of bladder material to be effectively welded, or sealably joined together along the boundary line to make the sock-shaped bladder. After the welding process, the excess material outside the bladder boundary is manually stripped away and the bladder is removed from the platen press. By these means, a sock-shaped bladder component with discrete particles of hot melt adhesive both inside and outside has been produced.

It is to be noted that the proper application of the adhesive to the inner and outer surfaces of the bladder is critical to the success of the manufacturing process, since, when completed, the sock must be breathable, flexible, pliant and waterproof and it must withstand laundering and physical abuse while being worn. It is to be noted that the adhesives can also be applied to the fabric components as an alternative means of construction.

As illustrated in FIGS. 1 and 2 of the drawings, the next step in the process of the invention is to place the first covering member, or inner sock 20 over a generally foot-shaped, approximately ⅛th inch thick, generally planer mandrel 27. Sock 20, which has inner and outer surfaces 20*a* and 20*b* is placed over the mandrel so that inner surface 20*a* thereof is disposed in engagement with the faces 27*a* of mandrel 27. As previously discussed, sock 20 can be constructed from a variety of materials. However, a sock which is made by Wigwam Mills, Inc. of Sheboygan, Wis. special knit pattern of its standard BK-1188 has proven satisfactory. An alternate inner sock, also made by Wigwam, is intended to impart cold weather comfort to the waterproof footwear article of the present invention depending on the climate encountered. For cold weather comfort, the inner sock can be made utilizing Thermax® made by E. I. dupont de Nemours and Co. of Wilmington, Del. For warm weather comfort the inner sock can be made utilizing Coolmax® made by duPont.

After sock 20 has been placed over mandrel 27 and smoothed out so that its inner surface is in close engagement with the faces of the mandrel 27, the bladder 12, which has been adhesive coated with particles of hot melt adhesive inside and outside is carefully placed over the assemblage of sock 20 and mandrel 27. The bladder is smoothed to be in close engagement with the outer surface of sock 20. Outer sock 22 is placed over both the inner sock 20 and the adhesive coated bladder assemblage on mandrel 27.

The precursor assembly comprising first sock 20, the adhesive coated bladder 12 and the second sock 22 is then heated and compressed in the direction of the arrows 34 in FIG. 2 to form the finished article. This step is accomplished by placing the mandrel, upon which the precursor assembly is mounted, between two platens which can be controllably heated and urged together. More particularly, the platens are preferably electrically heated to a temperature of about 280 degrees Fahrenheit and are controllably moved into pressural engagement with the precursor assembly by any type of hydraulically actuated pressure imparting assembly of a character well known to those skilled in the art. A commercially available press suitable for carrying out the method of the invention is sold by PHI of the City of Industry, Calif. During this temperature-pressure step, the heat activated adhesive is thereby fused making a permanent, water resistant bond of inner sock 20 to one side of the bladder and the outer sock 22 to the other side of the bladder. The minimum temperature required to activate the Bostik #5116 adhesive is 268 degrees Fahrenheit. Accordingly, a temperature range of between about 270 degrees Fahrenheit and 290 degrees Fahrenheit is preferred.

The precursor assembly is then removed from the press and allowed to cool thoroughly prior to doffing the completed waterproof footwear article from the mandrel.

When removed from the mandrel, the footwear article is generally planar in shape. However, upon inserting the foot into the open cuff of the article, the foot engaging portion of the sock will neatly and smoothly conform to the shape of the wearer's foot.

Depending upon the end use of the article, other commercially available adhesives can also be used in the practice of the method of the invention. By way of example, these include an adhesive sold by Stahl U.S.A. of Peabody, Mass. under the designation UE-4172 and an adhesive sold by Reichhold Chemicals, Inc. under the product code EA 6494. Further, a mixture of the Reichhold EA 6494 and a SOLUCOTE® 1024 adhesive made by Soluol Chemical Co., Inc. can be used for some end product applications.

When the adhesive used is in liquid form it can be sprayed, brushed or otherwise applied to the elastomeric bladder or sock fabric. As previously stated when the adhesive is applied to the bladder it must be applied in the manner, such as a dot matrix coating, which will not degrade the breathability characteristics of the bladder material.

It is to be understood that the method of the invention can be used to produce various articles of clothing such as socks and gloves. Such articles can be made in various sizes and design configurations to fit a wide variety of users.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a waterproof footwear article constructed of an inner fabric sock, an outer fabric sock and an intermediate pliant, waterproof, breathable bladder having a continuous extremity receiving portion in the general shape of the wearer's foot and having a continuous inner and outer surface, said method comprising the steps of:

(a) applying a thin layer of heat activated adhesive over the outer surface of the inner fabric sock to form a coated inner sock;

(b) placing the bladder over the coated inner sock to form a subassembly;

(c) applying a thin layer of adhesive over the inner surface of the outer fabric sock to form a coated outer sock;

(d) placing said coated outer sock over said subassembly so that said layer of adhesive is proximate said bladder to form a precursor article; and (e) heating said precursor article to a temperature sufficient to activate said heat adhesive whereby said inner and outer socks will be adhesively bonded to the continuous inner and outer surfaces of the bladder.

2. A method as defined in claim 1 in which said precursor article is compressed during said heating step in a manner to urge said inner and outer plies into close proximity with said bladder.

3. A method as defined in claim 1 in which said adhesive comprises urethane polymer and in which said assembly is heated to a temperature sufficient to cross link said urethane polymer.

4. A method as defined in claim 3 in which said assembly is heated to a temperature of approximately 300 degrees Fahrenheit.

5. A method as defined in claim 3 in which said bladder comprises a thin, elastomeric polyurethane film.

6. A method as defined in claim 5 in which said first and second socks comprise yarns made of fibers.

7. A method as defined in claim 5 in which said first and second socks comprise a material selected from the group consisting of nylon, polyester and combinations thereof.

8. A method of making an article of footwear comprising the steps of:

(a) constructing a waterproof, breathable, elastomeric bladder having a foot receiving portion including an outer surface and an inner surface having the ability to generally conform to the contour of a human foot comprising the steps of:

(i) overlaying two thin sheets of thermo plastic material of a character that will prevent penetration of liquid water while at the same time permitting free passage of moisture vapor such as that resulting from perspiration;

(ii) defining on said sheets of material a line circumscribing the boundary of said elastomeric bladder;

(iii) heating said sheets of material along said boundary line to a temperature sufficient to sealably bond said sheets together along said boundary line; and (iv) removing from said sheets excess material located externally of said boundary line;

(b) placing a first fabric sock having first and second surfaces over a thin generally foot-shaped planar mandrel with said first surface being located adjacent said mandrel;

(c) coating said second surface of said fabric sock with an adhesive to form a coated sock;

(d) placing said bladder over said coated sock to form a subassembly;

(e) placing a second fabric sock having a first and second surface over a thin, generally foot-shaped planar mandrel with said first surface in engagement with said mandrel;

(f) coating said second surface of said second fabric sock with an adhesive;

(g) removing said second sock from said mandrel and placing it over said subassembly with said second surface thereof in engagement with said bladder to form a precursor article; and (h) compressing said precursor article to urge said first and second fabric socks into engagement with said bladder.

9. A method as defined in claim 8 in which said adhesive is thermosetting and which includes the further step of heating said precursor article during the compressing step to a temperature sufficient to bond said first and second socks to said bladder.

10. A method as defined in claim 9 in which said adhesive is waterproof.

11. A method as defined in claim 9 in which said bladder comprises a thin polyurethane film.

12. A method as defined in claim 9 in which said first and second socks comprise knitted fibers.

13. A method as defined in claim 9 in which said first and second socks comprise polyester.

14. A method as defined in claim 9 in which said first and second socks comprise nylon.

15. A method of making a waterproof footwear article constructed of an inner sock, an outer sock and an intermediate pliant, waterproof, stretchable bladder having first and second continuous surfaces, defining a continuous extremity receiving portion having the general shape of the wearer's foot, said method comprising the steps of:

(a) applying adhesive onto the first surface of the bladder to form a coated bladder;

(b) placing the outer sock over the coated bladder to form a subassembly;

(c) turning said subassembly inside out to expose the second surface of the bladder;

(d) applying adhesive to the second surface of the bladder;

(e) placing the inner sock over said subassembly so that said adhesive is proximate said inner sock to form a precursor article; and (f) heating said precursor article to a temperature sufficient to securely bond together said bladder and said socks.

16. A method as defined in claim 15 in which the adhesive is in powder form and is applied to said bladder in a manner to provide a multiplicity of adhesive particles on said first and second surfaces of said bladder.

17. A method as defined in claim 15 in which said adhesive is a waterproof, hot meld powder adhesive and said precursor compressed during said heating step in a manner to urge said inner and outer socks into close proximity with said bladder.

18. A method as defined in claim 17 in which said bladder is polyurethane and in which said assembly is heated to a temperature of between 270 degrees Fahrenheit and 290 degrees Fahrenheit.

19. A method as defined in claim 18 in which said first and second socks comprise yarns made of fibers.

20. A method as defined in claim 18 in which said first and second socks comprise synthetic fibers.

21. A method as defined in claim 18 in which said first and second socks comprise a blend of natural and synthetic fibers.

22. An article of apparel used to cover a wearer's extremities comprising:

(a) a pliant, generally extremity-shaped hollow bladder constructed from a waterproof, breathable material, said bladder including as a part thereof, a continuous extremity covering portion for enclosing therewithin the extremity, including a continuous outer surface and a continuous inner surface generally conforming to the contours of the extremity; and (b) a generally extremity shaped covering member having a continuous surface attached directly to one of said continuous inner and outer surfaces of said bladder along a substantial portion thereof.

23. An article as defined in claim 22 in which said covering member is constructed of yarns made of fibers.

24. An article as defined in claim 22 in which said covering member is bonded to said bladder by a waterproof, breathable adhesive.

25. An article as defined in claim 22 in which said covering member is bonded to said bladder by a heat activated adhesive.

26. An article as defined in claim 22 further including a second covering member bonded to the other side of said inner and outer surfaces of said bladder.

27. An article as defined in claim 22 in which said article is adapted to cover a wearer's foot and in which said bladder and said first covering member are in the general shape of a human foot.

28. A waterproof footwear article for enclosing a wearer's foot, comprising:

(a) an elastomeric, breathable and waterproof stretchable elastic bladder having a continuous foot receiving portion the general shape of the wearer's foot and including continuous outer surface and a continuous inner surface generally conformable to the wearer's foot; and (b) inner and outer fabric socks bonded to said bladder along a substantial portion of said inner and outer surfaces of said bladder.

29. An article as defined in claim 28 in which said elastomeric bladder permits the water vapor content of perspiration to pass therethrough in a direction toward said outer sock, but prevents water in liquid form from passing therethrough toward said inner sock.

30. An article as defined in claim 29 in which said bladder comprises a material selected from a group consisting of urethane, polyurethane, and elastomers made from polyester, polyamides, cellulose derivatives and polyacrylic acid.

31. An article as defined in claim 29 in which said inner and outer socks are bonded to said bladder by a heat activated adhesive.

32. An article as defined in claim 29 in which said inner and outer socks comprise natural fibers.

33. An article as defined in claim 29 in which said inner and outer socks comprise synthetic fibers.

34. An article as defined in claim 29 in which said inner and outer socks comprise a blend of natural and synthetic fibers.

35. An article as defined in claim 29 in which said inner and outer socks comprise nylon fibers.

36. An article as defined in claim 29 in which said inner and outer socks comprise polyester fibers.

37. A waterproof footwear article for covering a wearer's foot comprising:

(a) a fabric inner ply having a bonding surface;

(b) a fabric outer ply having a bonding surface; and (c) a pliant intermediate ply comprising a thin, breathable waterproof elastic bladder having a continuous foot receiving portion having the general shape of the wearer's foot and including a continuous outer surface and a continuous inner surface generally conformable to the shape of the wearer's foot, said inner and outer plies being bonded to said intermediate ply along a substantial portion of said inner and outer surfaces thereof.

38. An article as defined in claim 37 in which said inner and outer plies are of knitted, seamless construction.

39. An article as described in claim 37 in which said bladder comprises a polyurethane film.

40. A method of making an article of footwear comprising the steps of:

(a) constructing a waterproof, breathable, elastomeric bladder having a foot receiving portion including an outer surface and an inner surface having the ability to generally conform to the contour of a human foot comprising the steps of:

(i) overlaying two thin sheets of thermo plastic material of a character that will prevent penetration of liquid water while at the same time permitting free passage of moisture vapor such as that resulting from perspiration;

(ii) defining on said sheets of material a line circumscribing the boundary of said elastomeric bladder;

(iii) heating said sheets of material along said boundary line to a temperature sufficient to sealably bond said sheets together along said boundary line; and (iv) removing from said sheets excess material located externally of said boundary line to form a smooth, continuous outer surface;

(b) coating the second surface of a first fabric sock having first and second surfaces with an adhesive to form a coated first sock;

(c) placing said bladder over said coated first sock to form a subassembly;

(d) coating the second surface of a second fabric sock with an adhesive; and (e) placing a said second sock having a first and second surface over said subassembly with said second surface thereof in engagement with said bladder to form a precursor article.

41. A method as defined in claim 40 which includes the further step of compressing said precursor article to urge said first and second fabric socks into engagement with said bladder.

42. A method as defined in claim 41 which includes the further step of heating said precursor article during the compressing step to a temperature sufficient to bond said first and second socks to said bladder.

* * * * *